US011390426B2

(12) United States Patent
Gonzalez Cortes

(10) Patent No.: US 11,390,426 B2
(45) Date of Patent: Jul. 19, 2022

(54) BAG-SEALING DEVICE

(71) Applicant: Jose Antonio Gonzalez Cortes, Ourense (ES)

(72) Inventor: Jose Antonio Gonzalez Cortes, Ourense (ES)

( * ) Notice: Subject to any disclaimer, the term of this patent is extended or adjusted under 35 U.S.C. 154(b) by 120 days.

(21) Appl. No.: 16/624,889

(22) PCT Filed: Jun. 8, 2018

(86) PCT No.: PCT/ES2018/070416
§ 371 (c)(1),
(2) Date: Dec. 19, 2019

(87) PCT Pub. No.: WO2019/002643
PCT Pub. Date: Jan. 3, 2019

(65) Prior Publication Data

US 2020/0130898 A1 Apr. 30, 2020

(30) Foreign Application Priority Data

Jun. 30, 2017 (ES) ..... ES201730875

(51) Int. Cl.
*B65D 33/16* (2006.01)
*B65D 33/24* (2006.01)

(52) U.S. Cl.
CPC ..... *B65D 33/24* (2013.01)

(58) Field of Classification Search
CPC ..... B65D 33/24; B65D 33/1616; B65D 33/1625; B65D 33/1633; B65D 33/165; B65D 33/1658; B65D 33/1666; B65D 33/1675; B65D 33/16; B65D 33/1641; B65D 33/1683
USPC ..... 383/42, 68, 70; 24/30.5 R, 30.5 W, 24/30.5 P, 30.5 S, 30.5 T; 446/222
See application file for complete search history.

(56) References Cited

U.S. PATENT DOCUMENTS 466,301 A * 12/1891 Green ..... B65D 33/1675 24/30.5 R
3,112,542 A * 12/1963 Brunson ..... B65D 33/1675 24/30.5 R (Continued)

FOREIGN PATENT DOCUMENTS

CA 571439 A 3/1959

*Primary Examiner* — Jes F Pascua
*Assistant Examiner* — Nina K Attel
(74) *Attorney, Agent, or Firm* — Hoglund & Pamias, PSC; Roberto J. Rios

(57) ABSTRACT

A mechanical elastic device is provided and designed for the closing and opening of bags manufactured from flexible material an indefinite number of times via the pressure exerted by this device (through taking the form of a Fermat's spiral) on the area of contact with the bag inserted into the same. The elastic device is operated by positioning the part of the bag to be fastened inside an interior space of the spiral and then aligning two hooks provided on the surfaces of the elastic device until they lock together, thus producing a reduction in the interior space of the spiral and, as a result, this part of the bag is tightened to remain hermetically sealed. The elastic device is opened by simply releasing the joined hooks with an external force, so the spiral will then return to its relaxed position and the bag can be extracted from the elastic device.

10 Claims, 1 Drawing Sheet

(56) References Cited

U.S. PATENT DOCUMENTS

| | | | | | |
|---|---|---|---|---|---|
| 3,259,302 | A | * | 7/1966 | Rocchisani | B65D 33/1616 24/30.5 R |
| 3,264,698 | A | | 8/1966 | Wright | |
| 3,503,119 | A | * | 3/1970 | Seitz, Jr. | B65B 51/04 29/509 |
| 4,270,247 | A | * | 6/1981 | Freedom | A45D 8/34 24/115 A |
| 4,947,523 | A | * | 8/1990 | Robbins, III | B65D 33/1675 24/30.5 R |
| 5,109,576 | A | * | 5/1992 | Teekell | B65D 33/1675 24/30.5 R |
| 5,495,645 | A | | 3/1996 | Suzuki et al. | |
| 5,682,649 | A | * | 11/1997 | Lo | B65D 33/1675 24/30.5 R |
| 2016/0183937 | A1 | | 6/2016 | Miraki et al. | |

* cited by examiner

BAG-SEALING DEVICE

FIELD OF THE INVENTION

The invention falls within the field of the procedures used by industries for the fastening (and subsequent opening by the customer) of bags manufactured using flexible materials (plastic, paper, cellophane, etc.)

The type of fasteners to which I refer should combine the following characteristics:

- They should exercise an external mechanical action on the object to be sealed.
- The same piece, with no alteration after use, should serve for the opening and closing of the bag as many times as necessary.

BACKGROUND OF THE INVENTION

The procedures currently available on the market: plastic-coated wire, adhesive tape, clamps, etc., are relatively unreliable and unsafe for the following reasons:

- They do not guarantee that the interior of the bag is maintained hermetically sealed during the product distribution process and thereby do not ensure the protection of the content from the external environment and the possible contamination effect or accelerated expiry of the product.
- The fastener can be easily manipulated and this can occur inadvertently and unnoticed by the distributors and consumers of the product.
- Once the bag is opened, reclosing it in a way that ensures that is hermetically sealed can be problematic.

SUMMARY OF THE INVENTION

The limitations and deficiencies of the bag fastening systems currently present on the market may be solved by making available a mechanism to replace them for a wide of range of uses which combines the following features:

- Simplicity of design
- Ease of use for the consumer
- Efficiency of the mechanism
- Safe results of the procedure
- Low production costs in order to avoid price increases for the product The fastening/opening system for bags manufactured in flexible materials which I propose is based on the tightening effect on the interior space of a piece in the form of a Fermat's spiral, manufactured using a material with the mechanical property of changing shape in an elastic manner (resilience), through the convergence of the sides on being subjected to a force induced by the movement of the end of the open branch of the outside of the spiral towards the outside surface of the closed part of the spiral, a force which is augmented by the pressure exercised by a curved appendage on the inside branch of the open end and maintaining itself in this position through the coupling of hooks which are incorporated into the piece.

BRIEF DESCRIPTION OF THE DRAWINGS

The drawings illustrating the explanation of the invention are included in the following figures.

DETAILED DESCRIPTION OF THE INVENTION

Figure 1:
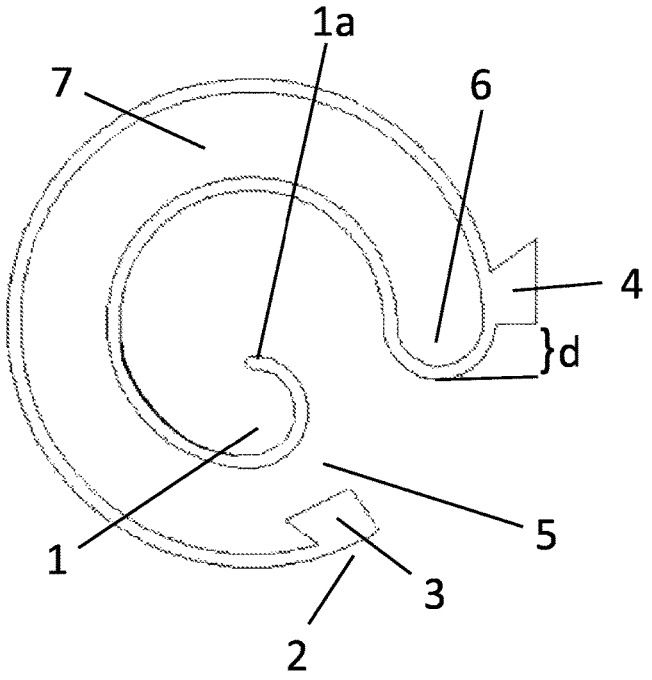
FIG. 1: A top view of the bag fastening device in the state prior to its use, without a bag yet being inserted.
Figure 2:
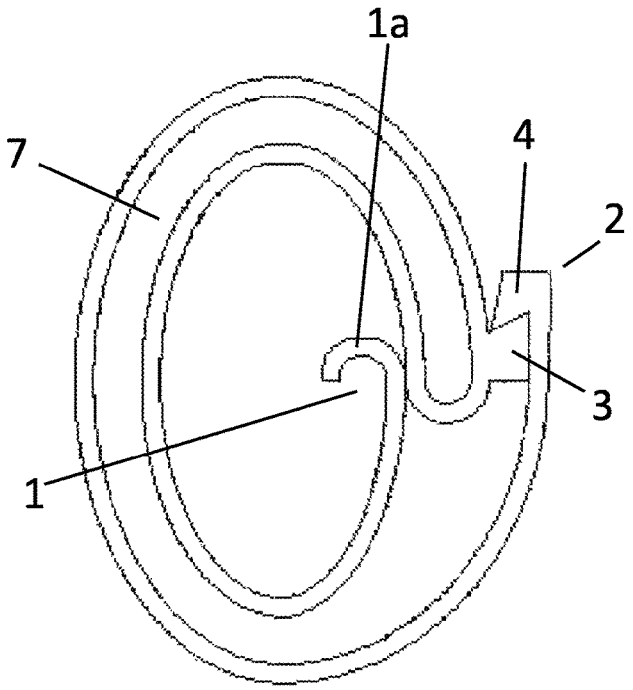
FIG. 2: A top view of the bag fastening device in the state in which the hooks have joined and with the bag now inside.
Figure 3:
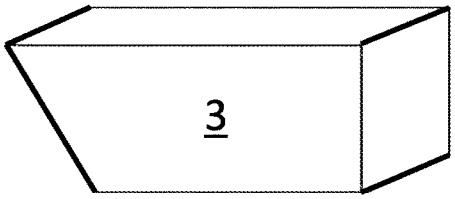
FIG. 3: A perspective view of an example of the hook for the device.

Description of the form of the device (FIG. 1):

The piece will be manufactured using a material which has the mechanical property of resilience. The piece of this material will take the form of a band (with the width and thickness appropriate for the type of bag) and will be molded into the shape of a spiral as shown in FIG. 1, but with the following modifications to its design compared with a conventional geometric shape:

- The inside branch (1) of the open end of the spiral will end with an appendage (1*a*) which curves towards the center of the spiral, which it will compress on closing.
- The outside branch (2) of the open end of the spiral will be shorter than the inside branch (1) of the same end of the spiral.
- The outside branch (2) of the open end of the spiral will have a hook (3) on the tip of its point and FIG. 3.
- On the outside surface of the closed part of the spiral there will be a hook (4) (see FIG. 3), located at a distance (d) from the tip of the curved end, as shown in FIG. 1, wherein the distance (d) will be proportional to the fastening pressure inside the interior space (7) of the spiral (i.e., the greater the distance between the hook (4) and the tip of the curved end, the greater the pressure the piece will exercise on the bag and the more hermetic the seal).

The fastening/opening procedure phases are as follows:

A FIG. 1

The part of the bag to be tightened should be inserted and moved inside the spiral from the initial position indicated in (5) to the final position as indicated in (6).

B FIG. 2

When the hook (3) on the open branch moves towards the position of the hook (4) on the closed branch both will latch together in a stable manner by virtue of their shape and the pressure exerted in opposite directions at the point of contact, thus having produced a reduction in the interior space (7) of the spiral and, as a result, the object located in the space indicated in (7) will be subjected to pressure from the sides of the spiral. In this manner the secure fastening of the inserted bag will be obtained.

C To release the contact between the hooks (3) and (4) it will only be necessary to apply an external force on the piece and, given its elasticity, one will then be able to separate the hooks (3) and (4) and extract the part of the bag inserted into the spiral, and in this manner the bag will be ready for opening.

D It will be possible to position a tape on the surface of the spiral for the purpose of improving the safety. This would make opening and manipulating the bag more difficult, thus ensuring the integrity of its content.

PREFERRED EMBODIMENT OF THE INVENTION

The explanation of the invention and the observation of the drawings in the figures present a preferred embodiment of the invention, describing the elements which comprise the device in a sufficient manner and the manner of operation of the same.

The invention claimed is:

1. A bag-sealing device comprising a continuous band shaped in the form of a Fermat's spiral having a closed end, an open end and an interior space (7) defined between said closed end and said open end inside inner surfaces of the spiral, wherein said closed end includes a first hook (4) protruding from an outer surface of the spiral near a tip of said closed end and said open end includes a first branch (1) with a curved appendage (1*a*) and a second branch (2) with a second hook (3) protruding from said inner surface of the spiral, said first branch (1) and said second branch (2) being separated to define an entrance (5) to said interior space (7) so that said first hook (4) and said second hook (3) are configured to latch together when the tip of said closed end is inserted through said entrance (5).

2. The bag-sealing device of claim 1, wherein said band is made from an elastic and resilient material.

3. The bag-sealing device of claim 1, wherein the interior space (7) of the spiral is reduced when the tip of said closed end is inserted through said entrance (5).

4. The bag-sealing device of claim 3, wherein the reduction of said interior space is proportional to a length of the second branch (2) of said open end.

5. The bag-sealing device of claim 3, wherein the reduction of said interior space is proportion to a distance (d) between said first hook (4) and the tip of said closed end.

6. The bag-sealing device of claim 1, wherein said interior space (7) is configured to receive a bag.

7. The bag-sealing device of claim 1, wherein the bag-sealing device is closed by pressing said spiral so that the tip of said closed end is inserted through said entrance (5) until said first hook (4) and said second hook (3) are latched together.

8. The bag-sealing device of claim 1, wherein the bag-sealing device is opened from a closed position where said first hook and said second hook are latched by pressing said spiral until said first hook (4) and said second hook (3) are unlatched so that the tip of said closed end comes out of said entrance (5).

9. The bag-sealing device of claim 1, further comprising a tape provided over said spiral when the bag-sealing device is closed.

10. The bag-sealing device of claim 1, wherein the curved appendage (1*a*) of said first branch (1) is curved away from said second hook (3).

* * * * *